US009580861B2

(12) United States Patent
Ford-Willcocks

(10) Patent No.: US 9,580,861 B2
(45) Date of Patent: Feb. 28, 2017

(54) IRON

(71) Applicant: Harry Ford-Willcocks, Cheltenham (GB)

(72) Inventor: Harry Ford-Willcocks, Cheltenham (GB)

( * ) Notice: Subject to any disclaimer, the term of this patent is extended or adjusted under 35 U.S.C. 154(b) by 0 days.

(21) Appl. No.: 14/783,875

(22) PCT Filed: Apr. 14, 2014

(86) PCT No.: PCT/GB2014/051163

§ 371 (c)(1),
(2) Date: Oct. 12, 2015

(87) PCT Pub. No.: WO2014/167365

PCT Pub. Date: Oct. 16, 2014

(65) Prior Publication Data

US 2016/0069013 A1 Mar. 10, 2016

(30) Foreign Application Priority Data

Apr. 12, 2013 (GB) ..... 1306718.6
Jun. 13, 2013 (GB) ..... 1310535.8

(51) Int. Cl.
*D06F 75/30* (2006.01)
*D06F 75/00* (2006.01)
(Continued)

(52) U.S. Cl.
CPC ..... *D06F 75/30* (2013.01); *A45D 2/00* (2013.01); *A45D 2/001* (2013.01); *D06F 75/00* (2013.01); *D06F 75/34* (2013.01); *D06F 87/00* (2013.01)

(58) Field of Classification Search
CPC ..... D06F 75/00; D06F 75/30; D06F 75/34; D06F 75/36; D06F 75/38; D06F 75/18; D06F 87/00; A45D 1/00; A45D 1/04; A45D 1/14; A45D 2/00; A45D 2/001; A45D 2/40; A45D 19/16; H05B 1/00
See application file for complete search history.

(56) References Cited

U.S. PATENT DOCUMENTS 1,455,696 A * 5/1923 Wright ..... A45D 1/04 132/224
2,748,511 A * 6/1956 Mariana Pezza ..... A47G 25/72 219/230
(Continued)

FOREIGN PATENT DOCUMENTS

DE 2718187 A1 8/1978
GB 2447750 A * 9/2008
WO 2005115194 A1 12/2005

*Primary Examiner* — Ismael Izaguirre
(74) *Attorney, Agent, or Firm* — Fraser Clemens Martin & Miller LLC; Michael E. Dockins

(57) ABSTRACT

An iron (10) which comprises a first arm (12) mounted to a second arm (14) about a pivot (16); where the first arm (12) includes a first arm body (20), a first arm opposing portion 18 and a grip handle (24); and the second arm (14) includes a second arm body (26) and a second arm opposing portion (23); where at least a portion of the grip handle (24) of the first arm (12) extends away from the first arm body (20) towards the second arm (14); with the first and second arms being movable about the pivot (16) between an open configuration in which the first arm opposing portion (18) is separated from the second arm opposing portion (23), and a closed configuration, in which the first arm opposing portion (18) is in contact with the second arm opposing portion (23); wherein movement of the second arm (14) towards the grip handle (24) brings the iron into the closed configuration from the open configuration.

20 Claims, 5 Drawing Sheets

(51) Int. Cl.

| | |
|---|---|
| ***D06F 87/00*** | (2006.01) |
| ***D06F 75/34*** | (2006.01) |
| ***A45D 2/00*** | (2006.01) |

(56) References Cited

U.S. PATENT DOCUMENTS

| | | | | |
|---|---|---|---|---|
| 3,577,859 | A * | 5/1971 | Davidson | D06F 75/30 219/245 |
| 3,752,017 | A * | 8/1973 | Lloyd | B23K 3/0307 219/221 |
| 4,739,151 | A * | 4/1988 | Smal | A45D 1/04 132/118 |
| 2005/0278988 | A1 | 12/2005 | Fernandez | |
| 2010/0212683 | A1* | 8/2010 | Mizuno | A45D 1/04 132/223 |
| 2010/0242986 | A1* | 9/2010 | Serresvives | A45D 1/04 132/227 |

* cited by examiner

IRON

CROSS-REFERENCE TO RELATED APPLICATIONS

This application is a National Stage of International Application No. PCT/GB2014/051163, filed Apr. 14, 2014, which in turn claims priority to Great Britain Patent Application No. GB1310535.8, filed Jun. 13, 2013, and Great Britain Patent Application No. GB1306718.6, filed Apr. 12, 2013. The entire disclosures of the above applications are hereby incorporated herein by reference.

FIELD OF THE INVENTION

The present invention relates to an iron, and particularly to a portable grip iron suitable for ironing or pressing, for example, clothes and curtains.

BACKGROUND TO THE INVENTION

Traditional ironing involving a large standard iron and ironing board can be unsuitable in many situations, particularly where travellers are unable to transport a bulky iron or ironing board. In a retail environment, it is impractical to move large amounts of clothing or fabric items to an iron and ironing board and it is impractical to move an iron and ironing board around the retail environment. It is difficult to move certain fabric items, such as curtains, to an iron and ironing board set up.

Small sized standard irons are available and are sufficiently portable for travellers, however they disadvantageously still require an ironing board or similar surface. Steamers are available providing a flow of steam or water vapour for easing creases from fabric, however current steamers are unsatisfactory as they are bulky and unable to apply high temperature or pressure to the fabric to be ironed.

Hand held irons are known in the art of hair straightening. These generally include two opposing arms attached to each other at a hinge, each arm including a heating plate, where ironing is achieved by the user grasping the arms with one hand and bringing the heating plates together by gripping the arms, with the item to be ironed (usually hair) positioned in between the plates. Attempts have been made to use such irons in ironing of fabric items. For example, U.S. Pat. No. 8,375,609 to Harrington discloses a hand held iron with opposing plates designed to iron hard to reach areas. However, such hand held fabric irons are only able to iron small items or the edges of larger items.

It can be seen from the foregoing that a need has arisen for an effective portable iron which can operate without an ironing board. It is therefore an object of the present invention to provide an iron which is portable and can be used without an ironing board.

STATEMENT OF INVENTION

According to the present invention there is provided an iron which has a first arm mounted to a second arm about a pivot; the first arm including a first arm body, a first arm opposing portion and a grip handle; and the second arm including a second arm body and a second arm opposing portion; where at least a portion of the grip handle of the first arm extends away from the first arm body towards the second arm; with the first and second arms being movable about the pivot between an open configuration, in which the first arm opposing portion is separated from the second arm opposing portion, and a closed configuration, in which the first arm opposing portion is in contact with the second arm opposing portion; wherein movement of the second arm towards the grip handle brings the iron into the closed configuration from the open configuration.

By virtue of the grip handle of the first arm extending towards the second arm, the depth of grip for operation of the device is reduced, i.e. it is not necessary to grip across the exterior of the first and second arms as the first arm grip handle is closer than the first arm body to the second arm body. When fabric is positioned for ironing between the opposing portions, there is contact between the inner surfaces of the opposing portions and the fabric. The opposing portions may include one or more heating plates, and the contact between opposing portions may be between the heating plates.

A heating plate may be provided on the first arm opposing portion, and a heating plate may be provided on the second arm opposing portion. The first arm heating plate may be articulated by one or more cushioning pads, and preferably two cushioning pads.

The opposing portions provide two ironing surfaces between which an item to be ironed may be placed, with one or more of these surfaces being heated. The use of one or more cushioning pads enables the heating plate to articulate its angle to iron fabrics more effectively where the thickness of the fabric (with or without appendages) is non-uniform, for example, at seams and buttons. By using two cushioning pads, the heating plate is capable of articulation about two orthogonal axes when pressure is applied, maintaining a larger contact area between the heating plate and the fabric than would otherwise be achieved without the cushioning pads.

Preferably, when the iron is in the closed configuration there is a first arm separation between the first arm body and the second arm body. Preferably, there is also a second arm separation between the first arm grip handle and the second arm body, and an increase in applied pressure when gripped whilst in the closed configuration does not cause the second arm body to bottom out or stop against the first arm grip handle. Preferably, the first arm separation is approximately 40 mm when in the open configuration.

The second arm separation means that any increase in applied pressure when gripped whilst the iron is in the closed configuration is transferred through the heating plates, since squeezing the grip handle and second arm body together tightly results in compression between the first arm opposing portion and the second arm opposing portion. Consequently, creases that are not smoothed by ironing with a normal amount of pressure can be tackled by applying increased pressure, which should allow the fibres to relax to a non-creased state given that the additional pressure is directed through the heating plates. The first arm separation between the first arm body and second arm body is also advantageous as it allows the clothes to gather without impeding the ability to continue ironing.

Preferably the iron pivot includes a spring wherein the spring is operative to hold the iron in the open position. Alternatively, the handles can be spring-loaded, wherein the spring is operative to hold the iron in the open position.

Preferably, the grip handle includes at least one ridge. More preferably, the grip handle includes three ridges, and is at least partially covered by a rubberised grip, preferably comprising an imide polymer.

The inclusion of ridges in the grip handle improves the ergonomics of the iron, making it easier to manipulate at different angles. Forming the grip handle from a rubberised material reduces the chance of dropping the iron whilst a user adjusts their grip, even where perspiration has moistened the grip handle, further improving the ease with which the iron can be manipulated. It is advantageous to use imide polymers as the rubberised material as they can be highly resistant to chemical, thermal and mechanical degradation, improving the operational lifetime of the grip handle.

The iron may be provided as part of a kit of additional items, including a hand held spray bottle, a sticky lint roller, and a door hanger for hanging clothes in a door opening for ironing. The door hanger may comprise a first arm and a second arm, wherein both the first arm and second arm are pivoted at one end and linked with an elastomeric material (tensioned when the first arm and second arm are spread). Each opposing end may have at least one hook which is tapered at its end. The second arm may have at least one hook at its pivoted end, from which clothes can be suspended.

The inclusion of a hand held spray bottle allows the user to wet the fabric independently of the iron, meaning that one area can be sprayed and allowed to absorb the spray (preparing it to be ironed in the case of significant creasing), whilst another area is ironed instead. The inclusion of a sticky lint roller means that dust, small fibres and other detritus on the surface of the fabric may be easily removed prior to ironing so that they are not ironed onto the fabric, which may otherwise cause damage to the fabric or lead to aesthetically displeasing results. The provision of a door hanger means that fabrics can be ironed whilst suspended from the door hanger, where the door hanger is mounted to the top edges of a door frame from the architrave. By using an elastomeric material (i.e. an elastic band) to link the first arm and second arm, placing them in tension when the arms are hooked to opposing sides of a doorframe, the door hanger firmly grips the top of the doorframe. The opposing end hooks which grip the top of the doorframe also grip firmly due to their tapered ends, which permit the hooks to grip the doorframe more securely.

The one or more heating plates incorporated into the iron may have rounded edges, preferably on their upper surfaces, where the upper surfaces may also lie proud of their housings (i.e. the parts of the handles which are not heated).

By rounding the edges on the exposed surfaces of any heating plates, the heating plates are much less prone to snagging on the fabric being ironed. It may also reduce mechanical degradation of the fabric, which may be otherwise accentuated by sharper edges where more fragile materials are present in the fabric being ironed. The same issue is also mitigated by mounting the heating plates to lie proud of their housings, so that the fabric predominantly contacts the heating plates and does not have excessive contact with the housing. It also ensures that the contact area between the heating plates and the fabric is maximised, which should ideally reduce the overall time needed to iron the fabric.

The one or more heating plates incorporated into the iron may exhibit non-stick exposed surfaces, preferably comprising a ceramic material or a layer of polytetrafluoroethylene.

Using non-stick heating plates reduces the chances of the fabric chemically bonding to the heating plates due to an increase in temperature, which could result in damage to the fabric upon attempted movement of the iron. It also contributes to smoother ironing movements, due to the low friction coefficient of typical flat ceramic surfaces. Heating plates coated with ceramic layers can be lighter than equivalent metal heating plates, which is particularly advantageous for this iron as it is designed for portable use. Alternatively, polytetrafluoroethylene (PTFE, commercially known as Teflon) also has a low coefficient of friction when applied as a flat layer, and would also contribute to similarly smooth ironing actions.

Preferably, if the iron is in the open configuration; there is a first arm separation between the first arm body and the second arm body; and there is an opposing portion separation between the first opposing portion and the second opposing portion; wherein the first arm separation is larger than the opposing portion separation.

An advantage of the present invention is that fabric items can be ironed without an ironing board. A further advantage is that the grip handle arrangement enables the device to be closed with a single hand in spite of the first and second arm bodies being too far apart for a single hand to reach. A still further advantage, where two heating plates are provided, is that the fabric item is heated on both sides simultaneously, as opposed to a traditional iron which heats a fabric only on one side. This results in faster ironing.

In one aspect, the invention may be provided by an iron which has an open configuration and a closed configuration including: a first arm which includes a first arm fixed end; a first arm body; a first arm opposing portion; a grip handle; and a second arm which includes a second arm fixed end; a second arm body; a second arm opposing portion; and a hinge; wherein the hinge is operative to pivotally attach the fixed end of the first arm to the fixed end of the second arm; wherein at least a portion of the grip handle extends away from the first arm body towards the second arm; wherein the iron is in the open configuration when the first arm opposing portion is separated from the second arm opposing portion; wherein the iron is in the closed configuration when the first arm opposing portion is in contact with the second arm opposing portion; wherein if the iron is in the open configuration bringing the second arm towards the grip handle is operative to bring the iron into the closed configuration.

It should be noted that the fixed ends above correspond to the pivoted ends as further described.

BRIEF DESCRIPTION OF THE DRAWINGS

For a better understanding of the present invention, and to show more clearly how it may be carried into effect, reference will now be made by way of example only to the accompanying drawings, in which.

DESCRIPTION OF PREFERRED EMBODIMENTS

Figure 1:
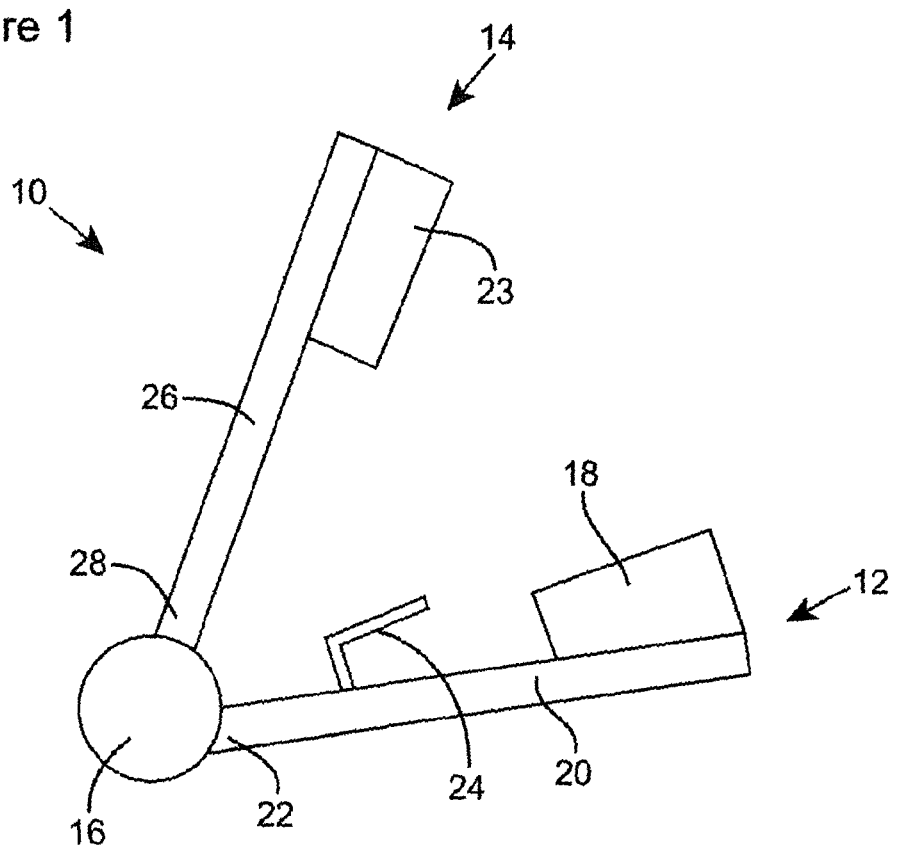
FIG. 1 shows a cross-sectional view of an embodiment of the invention in an open configuration.
Figure 2:
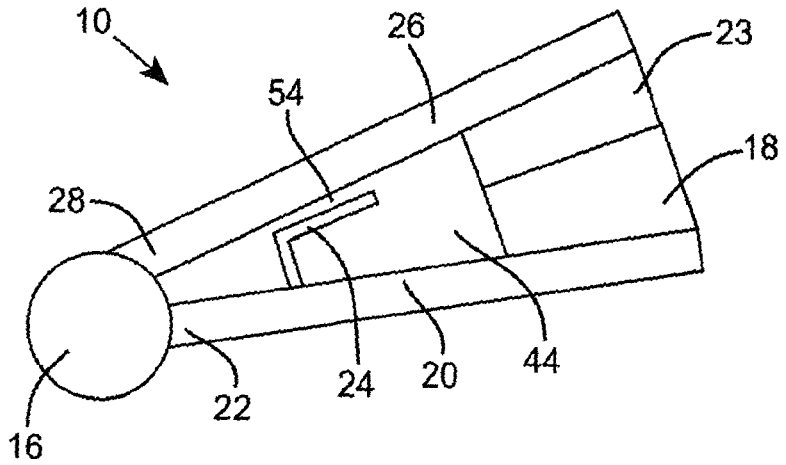
FIG. 2 shows a cross-sectional view of an embodiment of the invention in a closed configuration.
Figure 3:
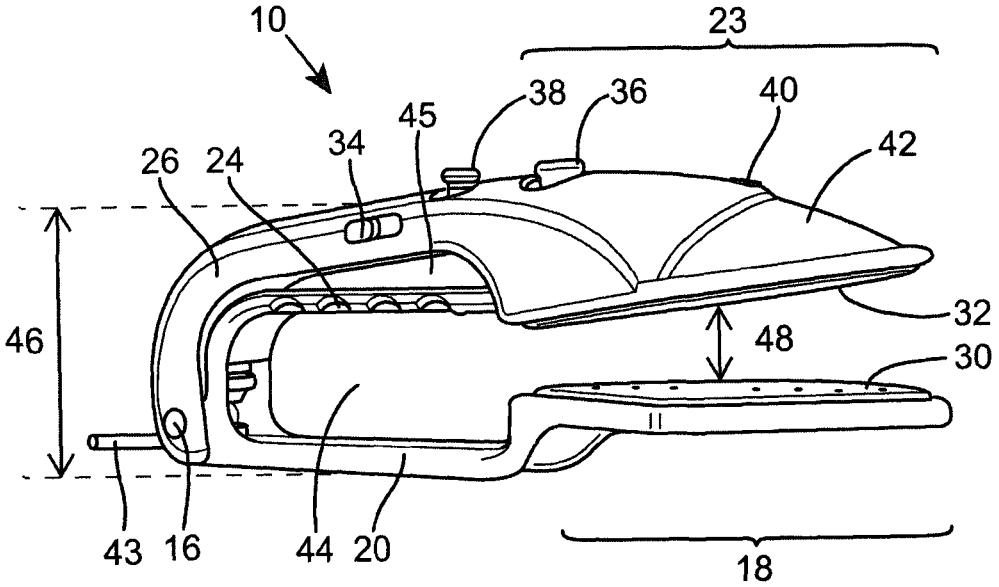
FIG. 3 shows a three-dimensional view of an embodiment of the invention in an open configuration.
Figure 4:
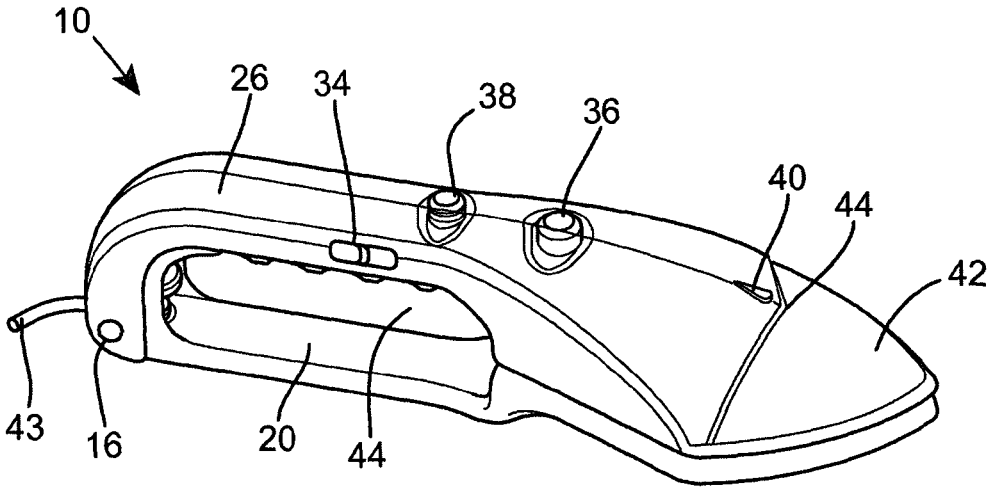
FIG. 4 shows a three-dimensional embodiment of the invention in a closed configuration.
Figure 5:
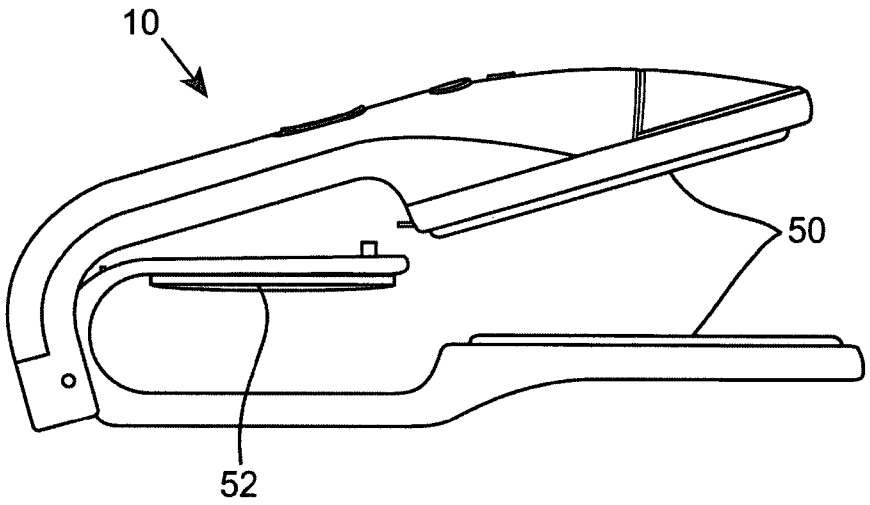
FIG. 5 shows a side view of an embodiment of the invention in an open configuration.
Figure 6:
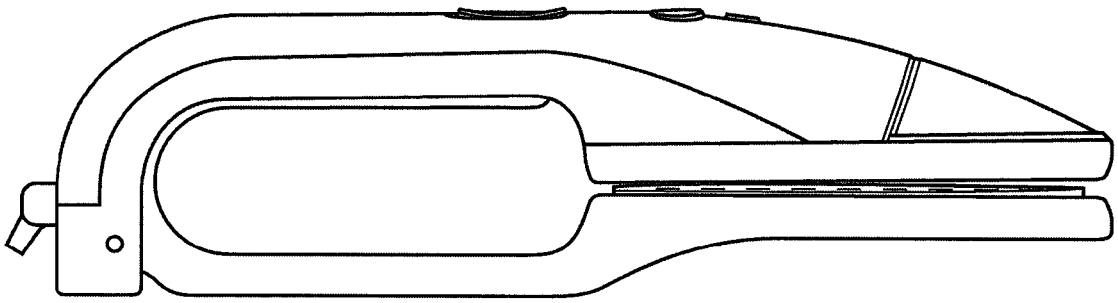
FIG. 6 shows a side view of an embodiment of the invention in a closed configuration.
Figure 7:
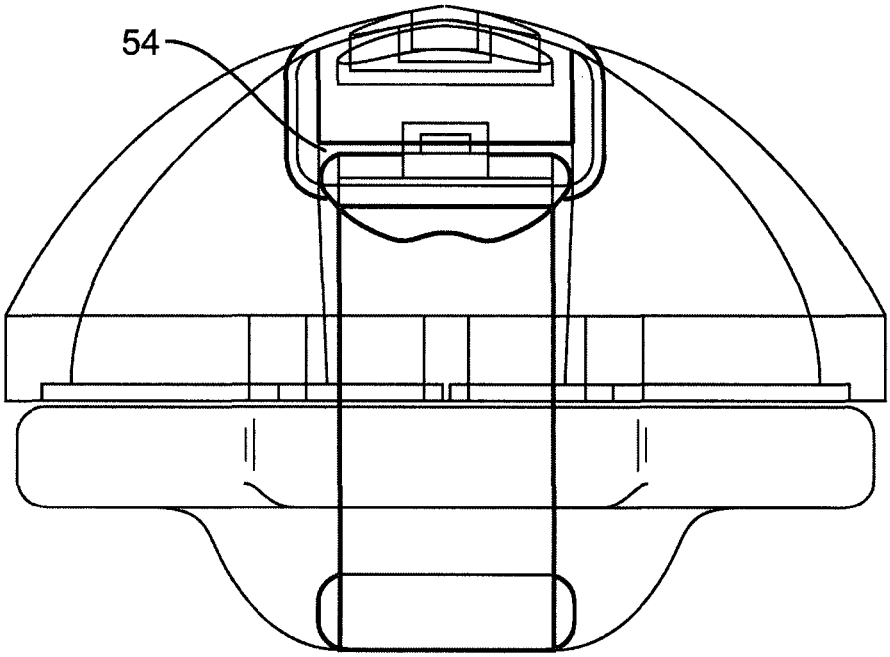
FIG. 7 shows a cross-sectional front view of an embodiment of the invention in a closed configuration.
Figure 8:
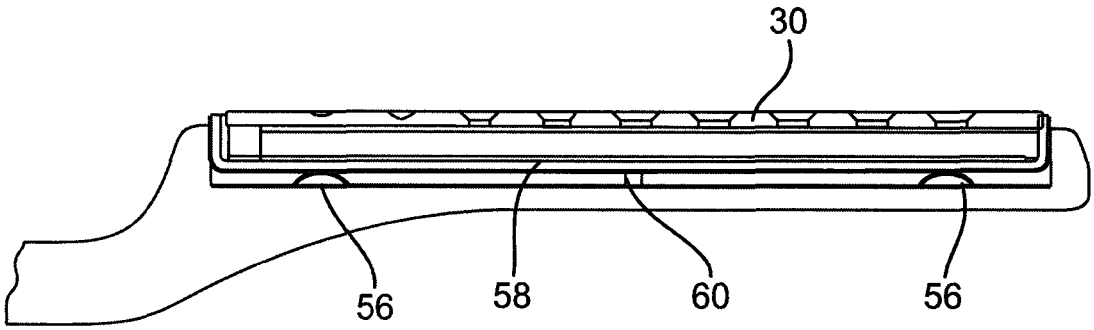
FIG. 8 shows a cross-sectional side view of an embodiment of the articulated heating plate of the invention.
Figure 9:
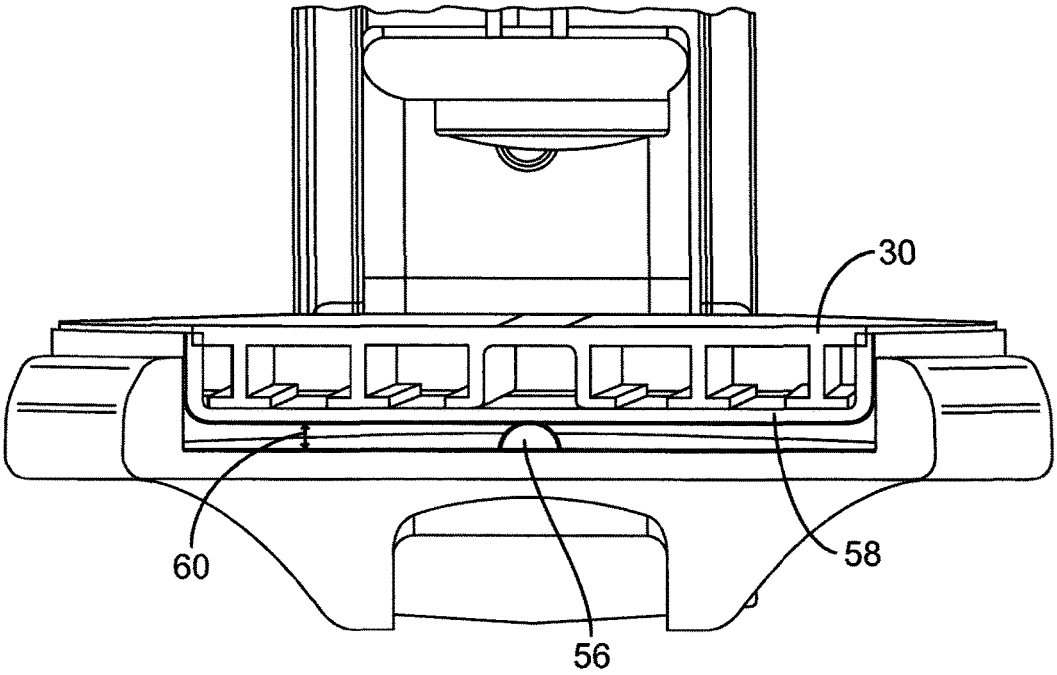
FIG. 9 shows a cross-sectional front view of an embodiment of the articulated heating plate of the invention.
Figure 10:
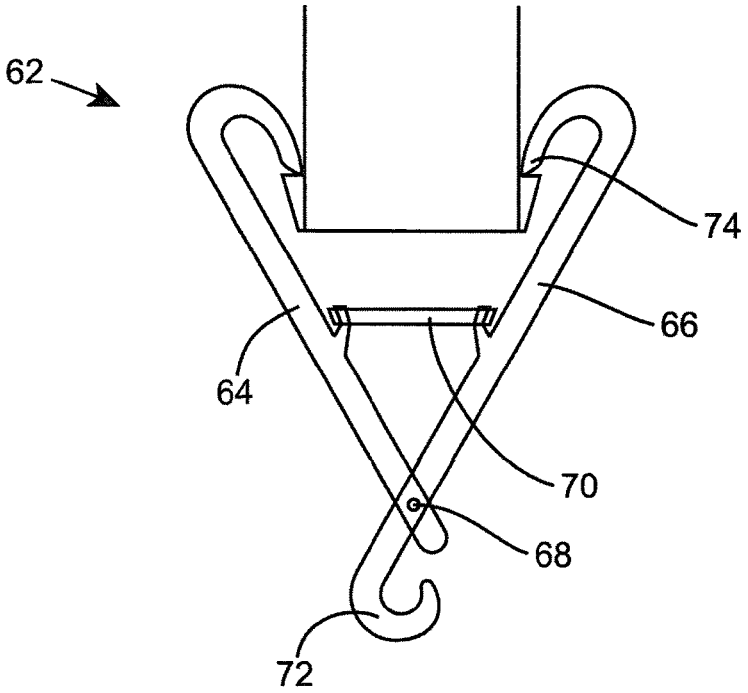
FIG. 10 shows a cross-sectional view of an embodiment of the door hanger of the invention.

Referring now to the drawings, where in all figures like numerals refer to like components, FIGS. 1 and 2 illustrate an embodiment of the invention. FIGS. 3 and 4 illustrate a preferred embodiment of the invention. FIGS. 5, 6 and 7 illustrate a preferred embodiment of the invention in open and closed configurations. FIGS. 8 and 9 illustrate a preferred embodiment of the cushioning pads for one of the heating plates in the invention. FIG. 10 illustrates a preferred embodiment of a door hanger. For clarity, not all components are labelled on all figures.

FIG. 1 illustrates an iron 10 of the invention in an open configuration. The iron includes a first arm 12, a second arm 14 and a pivot 16. First arm 12 includes a first arm opposing portion 18, a first arm body 20, a first arm pivoted end 22, and a grip handle 24. Second arm 14 includes a second arm opposing portion 23, a second arm body 26, and a second arm pivoted end 28. In the open configuration first arm opposing portion and second arm opposing portion are not in contact.

FIG. 2 illustrates an iron 10 of the invention in a closed configuration where the first arm opposing portion and second arm opposing portion are substantially in contact. The grip handle 24 and second arm body 26 are separated by a second arm separation 54 in a closed configuration, which allows the grip handle 24 and second arm body 26 to approach slightly when a tighter grip is applied. By gripping more tightly, the strain on the grip handle 24 is transmitted through the first arm 12 to the first arm opposing portion 18, which results in additional pressure being directed through the first arm opposing portion 18 and second arm opposing portion 23. This allows the user to modulate the pressure that they apply to iron the fabric according to the degree of creasing present.

FIG. 3 illustrates a preferred embodiment of the invention in the open configuration. In this embodiment first arm opposing portion 18 includes a first heating plate 30 and second arm opposing portion 23 includes a second heating plate 32. Mounted onto second arm 14 are a slide lock 34, a heat control dial 36, and a button 40 including an indicator light. In this embodiment iron 10 includes an electrical supply cord 43 attached to second arm 14. In the open configuration there is a first arm separation 44 between first arm body and second arm body and an opposing portion separation 48 between first and second opposing portions (between first heating plates 30 and second heating plates 32). In the open configuration there is a height of the iron 46.

FIG. 4 illustrates the iron of FIG. 3 in a closed configuration. Pivot 16 pivotally connects first arm 12 to second arm 14 at first arm pivoted end 22 and second arm pivoted end 28. If a user grasps grip handle 24 and second arm body 26 together the user can pull the iron into the closed configuration by pulling grip handle 24 towards second arm body 26. This is advantageous since, in the absence of the grip handle 24, the gap between the first and second arms would be too wide for a user to close with a single hand. The user can also apply pressure to an object placed between first arm opposing portion 18 and second arm opposing portion 23. Specifically, in embodiments comprising two heating plates the user can apply pressure to an object placed between first heating plate 30 and second heating plate 32. This application of pressure can advantageously be achieved by gripping with one hand.

FIG. 5 illustrates a side view of a preferred embodiment of the invention in an open configuration. The heating plates 50 are both proud of their respective casings, and each have smooth rounded edges. This is advantageous since it reduces the likelihood of fabric catching on the heating plates during ironing, and also causes less general wear to the fabric as it passes between the heating plates. The grip handle is covered by an elastomeric material 52, which increases the friction coefficient of the grip handle and means that the user is less likely to drop the iron whilst adjusting their grip.

FIG. 6 illustrates a side view of the iron 10 in FIG. 5 in a closed configuration, where the first arm opposing portion and second arm opposing portion are substantially in contact.

FIG. 7 illustrates a cross-sectional view of an embodiment of the invention in a closed configuration, as viewed from the front. The grip handle and second arm are notably separated by a second arm separation 54 when in the closed configuration, which allows the grip handle (24) and second arm body (26) to approach slightly when a tighter grip is applied. By gripping more tightly, the grip handle (24) transmits the applied force through the first arm (12) to the first arm opposing portion (18), which results in additional pressure being directed through the heating plates to the fabric being ironed, which can help smoothen any creases which are proving particularly resistant to being ironed out.

FIG. 8 illustrates a cross-sectional view of an embodiment of the articulated heating plate of the invention, as viewed from the side. The heating plate 30 is lined underneath with a heat resistant material 58, which is in turn supported by cushioning pads 56, leaving a separation 60 for articulation of the heating plate 30. The cushioning pads 56 contact the heating plate 30 in such a way as to articulate its plane about two orthogonal axes relative to the opposing heating plate by tilting it from side to side and from front to back. The heat resistant material 58 helps protect the cushioning pads 56 from thermal degradation as a result of their close proximity to the heating plate 30, as well as reducing the transfer of heat to the outside of the iron, minimising the likelihood of the user burning themselves on the exterior of the iron. The separation 60 allows for movement of the heating plate 30 as described during its articulation over the cushioning pads 56, when, for example, fabric of different thicknesses or appendages to the fabric are being ironed.

FIG. 9 illustrates a cross-sectional view of an embodiment of the articulated heating plate of the invention, as viewed from the front.

FIG. 10 illustrates a cross-sectional view of an embodiment of a door hanger 62. The first arm 64 and second arm 66 are pivotally connected by pivot 68 at one end, and linked by an elastomeric material 70 that enters tension when the first arm 64 and the second arm 66 are spread. The second arm 66 ends in a hook 72 at its pivoted end, whilst both the first arm 64 and the second arm 66 each end in a hook 74 at each end opposite to the pivot 68. Maintaining the elastomeric material 70 in tension during use helps the door hanger grip each side of the doorframe, whilst tapered ends to the hooks 74 maximise the grip above the doorframe.

Pivot 16, illustrated in an open position in FIGS. 1 and 3 and in a closed position in FIGS. 2 and 4, can be a separate component attached to the arms or can be formed by the arms themselves as is known in the art. Pivot 16 is preferably a sprung pivot comprising a spring for maintaining the pivot in the open position and thus the iron in an open position when the iron is at rest. Alternatively, other pivots of the art able to maintain the iron in the open position are suitable. An advantage of this is that the user only needs to apply force to close the iron, the iron naturally returning to the open configuration when the user releases the arms.

Alternatively, the arms can be spring-loaded, as is known in the art, wherein one or more than one spring mounted on one or more arm is operative to hold the iron in the open position.

Grip handle 24, the arms and the opposing portions are configured such that when iron 10 is both in open and closed configurations there is a first arm separation 44 between first arm body 20 and second arm body 26. This is advantageous as the space provides room for fabric to gather during the ironing process, facilitating ironing of entire garments or large portions of fabric. As mentioned previously, fabric between the opposing portions or heating plates can advantageously be pressed one-handed allowing the user to arrange fabric with the other hand, the invention thus affording ease and rapidity to the ironing process.

Grip handle 24 is also configured so that in the open configuration there is a second arm separation 45 between the grip handle and second arm body 26. This is advantageous as it provides space for pulling the grip handle up towards second arm body 26 when the user is closing the iron into the closed configuration.

In one embodiment the first arm separation 44 is approximately 40 mm when the iron is in the open configuration. In one embodiment the second arm separation 45 is approximately 30 mm when the iron is in the open configuration. In one embodiment a height of the iron 46 is approximately 80 mm in the open configuration.

Grip handle 24 is attached to first arm body 20 and is disposed towards the second arm. The grip handle 24 can be attached to first arm body 20, as illustrated, at one point or it can alternatively be attached at two points, for example it can be U-shaped. It can alternatively be attached to first arm pivoted end 22. Shapes and orientations where the grip handle rests in close proximity to the second arm in the closed configuration are preferable as this maximizes the space available for fabric to gather in the first arm separation 44 during the ironing process. A particularly preferable grip handle shape and orientation is illustrated in FIGS. 3 and 4. Although in the preferred embodiment of FIGS. 3 and 4 the first arm body 20 and grip handle are one piece, in an alternate embodiment first arm body 20 and grip handle are formed from two or more pieces attached to each other.

In one embodiment, as illustrated in FIGS. 3 and 4 grip handle 24 includes ridges or indentations. The ridges are shaped so that the fingers of a user fit one into each ridge. For example, there may be three ridges, enabling four fingers of a hand to be positioned around the ridges as known in the art. Advantages of this shape include providing improved comfort to a user using the device and preventing the user's hand from slipping from the correct position. Alternatively, the grip handle includes another device for improving grip, as is known in the art, such as materials providing an anti-slip surface e.g. rubber, textured plastic, where such materials may include imide polymers.

First and second heating plates, 30 and 32 respectively, in one embodiment, are electrically powered metallic iron heating plates as is known in the art. In a preferred embodiment the heating plates are ceramic coated, as is known in the art, or in an alternative embodiment the heating plates are coated by polytetrafluoroethylene (known commercially as Teflon). Furthermore any type of heating plate known in the art may be used. In one embodiment first and second arms, 12 and 14 respectively, have hollow portions for internal connection of electrical supply to the plates from electrical supply cord 43. Preferably, the shape of the opposing portions or heating plates is similar to that of a traditional iron with a V-shaped point as is known in the art. However other shapes for example a long narrow shape, a circular shape etc. are also envisioned and encompassed by the invention. Although the preferred embodiment of the invention as illustrated in FIGS. 3 and 4 includes two heating plates, one mounted on each opposing portion, in an alternative embodiment the iron includes one heating plate mounted one opposing portion.

First arm body 20 can be made of a variety of materials, including plastics, as is known in the art. First opposing portion 18 is preferably made of heat resistant material.

Second arm body 26 can be made of a variety of materials, including plastics, as is known in the art. Second opposing portion 23 is preferably made of heat resistant material. Optional components mounted on second arm 14 include slide lock 34, heat control dial 36, and button 40 which are mounted/incorporated into second arm 14. Further features and components well known in the art, such as an on/off switch, may also be included.

In one embodiment at least one of the arms and corresponding opposing portion is of a curved or stepped shape such that a heating plate separation 48 between first and second heating plates 30 and 32 respectively is smaller than first arm separation 44. Alternatively in the case where heating plates are not present on at least one opposing portion, the curved or stepped shape of at least one arm provides an opposing portion separation 48 between first arm opposing portion 18 and second arm opposing portion 23, which opposing portion separation is smaller than first arm separation 44. An advantage of this is that there is a reduced distance over which the opposing portions or plates must travel in order to iron (from the open configuration to the closed configuration).

The curved or stepped shape is preferably one step in one arm as shown in the figures, this being the simplest manufacture which provides the largest difference between the arm and heating plate or opposing portion separations. Alternatively there may be a series of steps, a curve, a series of curves for example an S-shape, or a mixture of curves and steps. The curved or stepped shape may be any non-linear inner shape of either or both arms which provides a separation between the plates or opposing portions which is smaller than that between the arms.

Slide lock 34 is a sliding lock, as known in the art, in a locked position is able to hold the iron in the more compact closed configuration for ease of transport.

Heat control dial 36, is a dial for setting the iron temperature, as is known in the art. In one embodiment markings on second arm 14 and heat control dial 36 allow the user to select an iron temperature.

In one embodiment button 40 includes an indicator light. The indicator light can be LED, filament or any other suitable light source. The indicator light can be used in a number of ways, indicating, for example, that the iron has warmed to the required temperature upon being plugged in or switched on. One or more indicator lights for one or more than one purpose, can be mounted on another portion or portions of the iron.

Power supply cord 43 which in one embodiment is attached to a plug (not illustrated) provides electrical power to the iron. Electrical connection from power supply cord 43 to components of the iron can be through wiring routed through a hollow portion or portions of the arm or arms, as is known in the art. In an alternative embodiment, the iron is battery powered. One or more batteries can be mounted internally to an arm or both arms or mounted externally to the iron.

In one embodiment the iron is compact in size measuring approximately 298 mm by 77 mm by 100 mm. In one embodiment the iron heating plates are able to provide a heating range of between 170° C. and 230° C. approximately. As mentioned previously, the desired iron heat can be user specified by heat control dial 36.

Although arm bodies and arm opposing portion have been described as separate components combined body-opposing portion component or components are suitable and encompassed by the invention.

Although ironing has be discussed with reference to the ironing of fabric the iron of the invention is suitable for ironing other materials and for any use where the application of pressure and/or heat are required.

While the invention has been described with respect to a limited number of embodiments, it will be appreciated that many variations, modifications and other applications of the invention may be made. It is also to be understood that the embodiments described may be combined. Therefore, the claimed invention as recited in the claims that follow is not limited to the embodiments described herein.

The invention claimed is:

1. An iron comprising:

a first arm mounted to a second arm about a pivot, the first arm including a first arm body, a first arm opposing portion and a grip handle, and the second arm including a second arm body and a second arm opposing portion, at least a portion of the grip handle of the first arm extending away from the first arm body towards the second arm;

the first and second arms being movable about the pivot between an open configuration in which the first arm opposing portion is separated from the second arm opposing portion, and a closed configuration in which the first arm opposing portion is in contact with the second arm opposing portion;

wherein movement of the second arm towards the grip handle brings the iron into the closed configuration from the open configuration.

2. The iron of claim 1, in which a plate is mounted to at least one of the arm opposing portions.

3. The iron of claim 2, in which at least one of the plates is resiliently mounted, enabling articulation about one or two orthogonal axes.

4. The iron of claim 2, in which at least one of the plates is a heating plate.

5. The iron of claim 2, in which the first arm opposing portion includes a first heating plate; the second arm opposing portion includes a second heating plate; and the first heating plate is supported by at least two cushion pads which articulate the angle of the plane of the first heating plate relative to the plane of the second heating plate; and in the closed configuration the first heating plate is in contact with the second heating plate.

6. The iron of claim 5, in which each heating plate has rounded edges, where the upper surface of each heating plate lies proud of the housing for each heating plate.

7. The iron of claim 5, in which each heating plate has a non-stick exposed surface.

8. The iron of claim 7, in which the non-stick exposed surface of each heating plate is either ceramic or covered with a layer of polytetrafluoroethylene.

9. The iron of claim 1, in which there is a first awl separation between the first arm body and the second arm body when the iron is in the closed configuration.

10. The iron of claim 1, in which there is a second arm separation between the first arm grip handle and the second arm body when the iron is in the closed configuration, where an increase in applied pressure whilst in the closed configuration does not cause the second arm body to bottom out or stop against the first arm grip handle.

11. The iron of claim 1, wherein if the iron is in the open configuration:

(i) there is a first arm separation between the first arm body and the second arm body; and (ii) there is an opposing portion separation between the first opposing portion and the second opposing portion;

wherein the first arm separation is larger than the opposing portion separation.

12. The iron of claim 1 wherein the pivot further comprises a spring; the spring being operative to hold the iron in the open position.

13. The iron of claim 1, wherein an arm further comprises a spring; wherein the spring is operative to hold the iron in the open position; wherein the arm is selected from the group comprising the first arm and the second arm.

14. The iron of claim 1, wherein the grip handle comprises at least one ridge.

15. The iron of claim 14, wherein the grip handle comprises three ridges.

16. The iron of claim 1, wherein the grip handle is at least partially covered by a rubberised grip.

17. The iron of claim 16, wherein the rubberised grip comprises an imide polymer.

18. The iron of claim 9, in which at least one of the arms has a shape selected from the list comprising: curved, stepped; whereby an opposing portion separation is smaller than the first arm separation.

19. The iron of claim 1, in which in the closed configuration, the opposing portion separation is smaller than the first arm separation.

20. An iron comprising:

an open configuration;

a closed configuration; and a first arm comprising:

a first arm fixed end; and a first, arm body; and a first arm opposing portion; and a grip handle; and a second arm comprising:

a second arm fixed end; and a second arm body;

a second arm opposing portion; and a hinge;

wherein the hinge is operative to pivotally attach fixed end of the first arm to the fixed end of the second arm;

wherein at least a portion of the grip handle extends away from the first arm body towards the second arm;

wherein the iron is in the open configuration when the first arm opposing portion is separated from the second arm opposing portion;

wherein the iron is in the closed configuration when the first arm opposing portion is in contact with the second arm opposing portion;

wherein if the iron is in the open configuration bringing the grip handle towards the second arm is operative to bring the iron into the closed configuration.

* * * * *